US010722037B2

(12) United States Patent
Pendleton, Jr.

(10) Patent No.: US 10,722,037 B2
(45) Date of Patent: Jul. 28, 2020

(54) RETRACTABLE BEVERAGE HOLDER

(71) Applicant: Brian T. Pendleton, Jr., Arlington, MA (US)

(72) Inventor: Brian T. Pendleton, Jr., Arlington, MA (US)

( * ) Notice: Subject to any disclaimer, the term of this patent is extended or adjusted under 35 U.S.C. 154(b) by 0 days.

(21) Appl. No.: 16/378,795

(22) Filed: Apr. 9, 2019

(65) Prior Publication Data

US 2019/0307253 A1 Oct. 10, 2019

Related U.S. Application Data

(60) Provisional application No. 62/654,852, filed on Apr. 9, 2018.

(51) Int. Cl.
*A47C 7/62* (2006.01)

(52) U.S. Cl.
CPC ..... *A47C 7/624* (2018.08)

(58) Field of Classification Search
CPC ..... A47C 7/624; A47C 7/62; A47C 7/622
USPC ..... 297/188.15, 188.14, 188.16, 188.18
See application file for complete search history.

(56) References Cited

U.S. PATENT DOCUMENTS 2,690,950 A * 10/1954 Nordmark ..... A47B 41/02 312/310
5,586,804 A * 12/1996 Burroughs ..... A47O 7/62 297/188.08
6,361,105 B1 * 3/2002 Turner ..... A47O 7/62 297/16.2
8,182,031 B1 * 5/2012 MacKenzie ..... A47B 3/08 108/125
8,636,319 B1 * 1/2014 Parker, Jr. ..... A47O 7/62 248/311.2
9,532,654 B1 * 1/2017 Adams, IV ..... A47O 5/12
2010/0026057 A1 * 2/2010 Miller ..... A47O 4/22 297/21
2011/0121619 A1 5/2011 Chappell
(Continued)

OTHER PUBLICATIONS

Pawkeys Island, "Cup Holder CH1-K," http://pawleysislandhammocks.com/Cup-Holder/CH1-K, 3 pages, (Captured by the Internet Archive on Jan. 4, 2018; available at: https://web.archive.org/web/20180104230805/http://pawleysislandhammocks.com/Cup-Holder/CH1-K).

(Continued)

*Primary Examiner* — Mark R Wendell
(74) *Attorney, Agent, or Firm* — Hamilton, Brook, Smith & Reynolds, P.C.

(57) ABSTRACT

The present disclosure relates generally to a beverage holder designed to be mounted to the underside of an armrest and may be retracted under the armrest when not in use. Embodiments of the present disclosure include a retractable beverage holder (RBH) with a mounting bracket that provides support to the beverage holder when the beverage holder is retracted under the armrest, and when the beverage holder is extended out from under the armrest. Embodiments of the present disclosure include, for example, a dual option retractable beverage holder (DORBH) having both a wine glass holder, and a cup holder. Another example embodiment is a single option retractable beverage holder (SORBH) comprising a wine glass holder and a mounting bracket, or a cup holder and a mounting bracket.

17 Claims, 8 Drawing Sheets

(56) References Cited

U.S. PATENT DOCUMENTS

2019/0210732 A1* 7/2019 Green ..... A47O 7/624

OTHER PUBLICATIONS

Pawkeys Island, "Wine Holder WH1-K," http://pawleysislandhammocks.com/Wine-Holder/WH1-K, 2 pages, (Captured by the Internet Archive on Jan. 1, 2018; available at: https://web.archive.org/web/20180101124653/http://pawleysislandhammocks.com/Wine-Holder/WH1-K).

* cited by examiner

RETRACTABLE BEVERAGE HOLDER

RELATED APPLICATION

This application claims the benefit of U.S. Provisional Application No. 62/654,852, filed on Apr. 9, 2018. The entire teachings of the above application are incorporated herein by reference.

BACKGROUND

Wide-armed chairs, for example Adirondack chairs, are a comfortable option for outdoor seating. Balancing a cup or wine glass on the armrest of the chair can be difficult, however, and beverages are prone to spill when the chair is bumped. Existing beverage holders made for wide-armed chairs are conspicuous, not versatile in the types of beverage containers they can support, and detract from the aesthetics of the chair while not in use.

SUMMARY

The present disclosure provides inventive solutions to avoiding spilled drinks, and the nuisance of having to hold a beverage while relaxing in a chair. The present disclosure describes a unique beverage holder that frees up an armrest of a chair for allowing a user to rest his or her arm, holding a plate, or supporting reading materials. While other beverage holders exist for this purpose, none has beneficial design elements, or functionality as those described in detail below.

The present disclosure relates generally to a beverage holder, designed to be mounted to the underside of an armrest, that may retract under the armrest when not in use. Embodiments of the present disclosure include a retractable beverage holder (RBH) with a mounting bracket that provides support to the beverage holder when the beverage holder is retracted under the armrest and when the beverage holder is extended out from under the armrest. The mounting bracket may have a symmetrical form that enables the mounting bracket to be mounted under either the right or left armrest of a chair. The RBH can be mounted under an armrest of a chair (particularly wide-armed chairs), and many other flat surfaces, including, but not limited to, a table, deck railings, desk, countertop, swing, or bench. As a nonlimiting example, the present disclosure describes and illustrates the RBH in relation to a wide-armed chair, such as an Adirondack chair; however, one of skill in the art should understand that the RBH is not limited for use with chairs or armrests.

According to some embodiments, the RBH may include a cup holder, wine glass holder (or both), and a mounting bracket for attaching the RBH to the underside of an armrest or other flat surface. The example embodiments of the RBH described in detail below are particularly well suited for mounting to wide-armed chairs, for example Adirondack chairs, or any other type of seat with an arm rest. Embodiments of the present disclosure include, for example, a dual option retractable beverage holder (DORBH) having both a wine glass holder, and a cup holder. Another example embodiment disclosed hereinbelow is a single option retractable beverage holder (SORBH) comprising a wine glass holder and a mounting bracket, or a cup holder and a mounting bracket.

Embodiments of the present disclosure include an apparatus comprising a mounting bracket that defines a first flat surface and a barrier extending above and adjacent to the first flat surface. In some embodiments, the barrier may form an angle (e.g., an obtuse angle) along a length of adjacent sides of the mounting bracket. On top of the barrier may be a second flat surface defining an opening for at least two mounting holes that extend through the barrier.

The apparatus may further comprise a beverage holder having an operative arm with a bottom surface resting on the first flat surface of the mounting bracket and with a top surface below or even with the second flat surface on top of the barrier. The operative arm may have a mounting end coupled to the mounting bracket such that the operative arm is configured to pivot across the first flat surface within the angle of the barrier.

According to some embodiments, the angle formed along the length of adjacent sides of the mounting bracket is obtuse, enabling the beverage holder to extend perpendicular to an armrest when in use, and fully retract under the armrest when stored and not in use.

According to some embodiments, the mounting bracket may be sized and shaped to be attached to a bottom surface of an armrest, with the second flat surface on the top of the barrier in contact with the bottom surface of the armrest. In some embodiments, the mounting bracket is designed to provide support for the beverage holder near the edge of the chair thereby reducing the moment force exerted on the mounting screws.

In some embodiments, the barrier defines at least three mounting holes, with one of the mounting holes being at a vertex of the angle of the barrier and two mounting holes are located on opposite ends of the barrier from an end at the vertex. In some embodiments, the mounting bracket includes a molded stem on the first flat surface such that an assembly hole in the mounting end of the operative arm may be placed over the molded stem.

According to some embodiments, the barrier of the mounting bracket may be a first barrier, and the mounting bracket further includes a second barrier extending upward from the second flat surface on top of the first barrier with substantially the same angle of the first barrier, and a third flat surface on top of the second barrier. The third flat surface may have a smaller surface area than the second flat surface, and the mounting holes further extend through the second barrier and the third flat surface.

According to some embodiments, the beverage holder of the apparatus may be a first beverage holder, the operative arm of the apparatus may be a first operative arm, and the apparatus further comprises a second beverage holder. The second beverage holder may include a second operative arm with a bottom surface resting on the second flat surface on top of the first barrier, and a mounting end of the second operative arm may be coupled to the mounting bracket such that the second operative arm is configured to pivot within the angle of the second barrier.

In some embodiments, the second operative arm of the second beverage holder may be wider than the first operative arm of the first beverage holder. This allows the second operative arm to be supported by the second flat surface, reducing the moment force exerted on the mounting screw.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Reference Numbers of the Figures

Figure 1B:
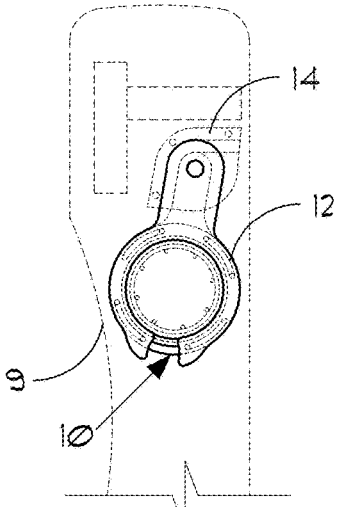
FIG. 1B shows a top view of a dual option retractable beverage holder with both beverage holding options in a retracted position under an armrest.

7—Adirondack chair
9—Armrest
10—Cup holder
12—Wine glass holder for a DORBH
14—Mounting bracket for a DORBH
016—Operative arm of the cup holder
17—Mounting end of the cup holder
18—Solid base of the woven basket (i.e., puck)
19—Circular portion of cup holder
20—Woven Basket
21—Paracord (or other flexible material)
22—Assembly hole in the mounting end of the cup holder
24—Weaving holes through the top of the circular portion of cup holder
26—Circular opening of the cup holder
28—Recessed channel for paracord
30—Weaving holes through the puck
31—Knotted paracord
32—Hollow bottom of puck
34—Assembly hole in the mounting end of the wine glass holder
36—Opening in which wine glass holder
38—Gap
40—Tabs
42—Molded stem
44—Mounting holes in mounting bracket
46—Barrier
48—Top of the barrier
49—Top of the barrier
50—Barrier
52—Flat surface of mounting bracket
54—Angle formed by the adjacent sides of the mounting bracket
62—Wood screws
64—Bottle opener
66—Operative arm of a wine glass holder
67—Mounting end of operative arm
112—Wine glass holder for a SORBH
114—Mounting bracket for a SORBH
116—Operative arm of the cup holder
119—Circular portion of cup holder
122—Assembly hole
124—Weaving holes through the side of the circular portion of a cup holder
130—Weaving holes through the side of the puck
132—Hollow bottom of the puck
142—Molded stem of mounting bracket
144—Mounting holes of mounting bracket
148—Top of the barrier
150—Barrier
152—Flat surface of mounting bracket
166—Operative arm of a wine glass holder
219—Circular portion of cup holder

224—Hooks on the bottom of the circular portion of a cup holder

242—Assembly hole of mounting bracket

342—Assembly hole of mounting bracket

810*a*—Cup holder

810*b*—Cup holder

818—Solid base of the woven basket (i.e., puck)

A description of example embodiments follows.

The teachings of all patents, published applications and references cited herein are incorporated by reference in their entirety.

Embodiments of the retractable beverage holder (RBH) disclosed herein have multiple options for holding beverages depending on a user's drinkware. Different options of the RBH offer increased functionality by accommodating multiple types of beverages including but not limited to: a variety of styles of glasses, cans, bottles, wine glasses, and tapered coffee mugs.

One option may be a cup holder with a round opening and a woven basket created from paracord or other flexible material that hangs down to support a beverage container. In some embodiments, there may be a solid base, interchangeably referred to herein as a "puck," in the bottom of the woven basket to provide additional support. The woven basket designs of present disclosure provide a flexible holding device that is less susceptible to breakage than previous rigid cup holders. The cup holders illustrated and described herein hold many types of glasses, bottles, cans, and juice boxes, et cetera. The weave of the basket also allows the woven basket to hold other items, including but not limited to, a cell phone and other electronic devices.

Another beverage holding option may be a wine glass holder having a round opening with a gap that allows for the stem of a wine glass to slide through and into position in the wine glass holder. The gap further enables the wine containing portion of the wine glass to rest on the inside circular opening of the wine glass holder. The wine glass holder provides a sturdy holder for various types of wine glasses, and tapered coffee mugs.

Further, the RBH may be symmetrical and, therefore, is easily attached to either the right or left arm of a chair depending on user preference. According to some embodiments, the RBH is mounted to the underside of an armrest of a chair with screws (or other forms of mounting hardware known in the art) such that the RBH is not visible from above the armrest, thereby maintaining the classic look of the chair. The mounting bracket may be engineered to provide various levels of resistance to pressure and to provide stability to the beverage container without unduly pulling on the armrest of the chair. The mounting bracket may further be designed so the edge of the mounting bracket on adjacent sides acts as a stopping point when a beverage holder is extended out while in use, and when the beverage holder is retracted under the armrest of the chair while not in use.

The mounting bracket edge may also provide guidance for alignment and positioning when mounting the RBH to the underside of the armrest. The handle of both the cup holder and wine glass holder may rest on a supportive ledge or shelf to provide greater structural support. Rather than merely attaching the beverage holders directly to the armrest, which would create a lever effect where usage would impact integrity of the beverage holder, the mounting bracket may be specially designed to provide leverage support to the beverage holders to make breakage and loosening of the mounting hardware less likely.

Careful positioning of the mounting hardware in the mounting bracket makes the RBH sturdier than other models. The holes for the mounting hardware in the mounting bracket are strategically placed close to the edge of mounting bracket, which reduces the pressure on mounting hardware caused by the leverage force of the beverage container, and makes the mounting hardware less susceptible to loosening and pulling out. The additional mounting hardware provides extra stability to hold the RBH in place. When not in use, the RBH conveniently retracts under the armrest of the chair and is not visible from above, maintaining the natural look of the iconic Adirondack chair.

FIGS. 1A-1D illustrate an example embodiment of the dual option retractable beverage holder (DORBH) that may, for example, include both a wine glass holder and a cup holder.

Figure 1C:
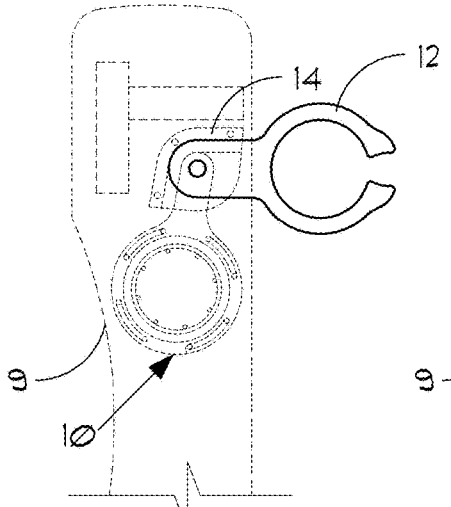
FIG. 1C shows a top view of a dual option retractable beverage holder with a first beverage holding option in an extended position.
Figure 1D:
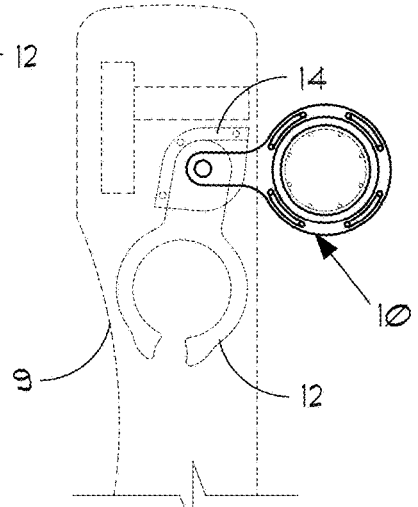
FIG. 1D shows a top view of a dual option retractable beverage holder with a second beverage holding option in an extended position.
Figure 1A:
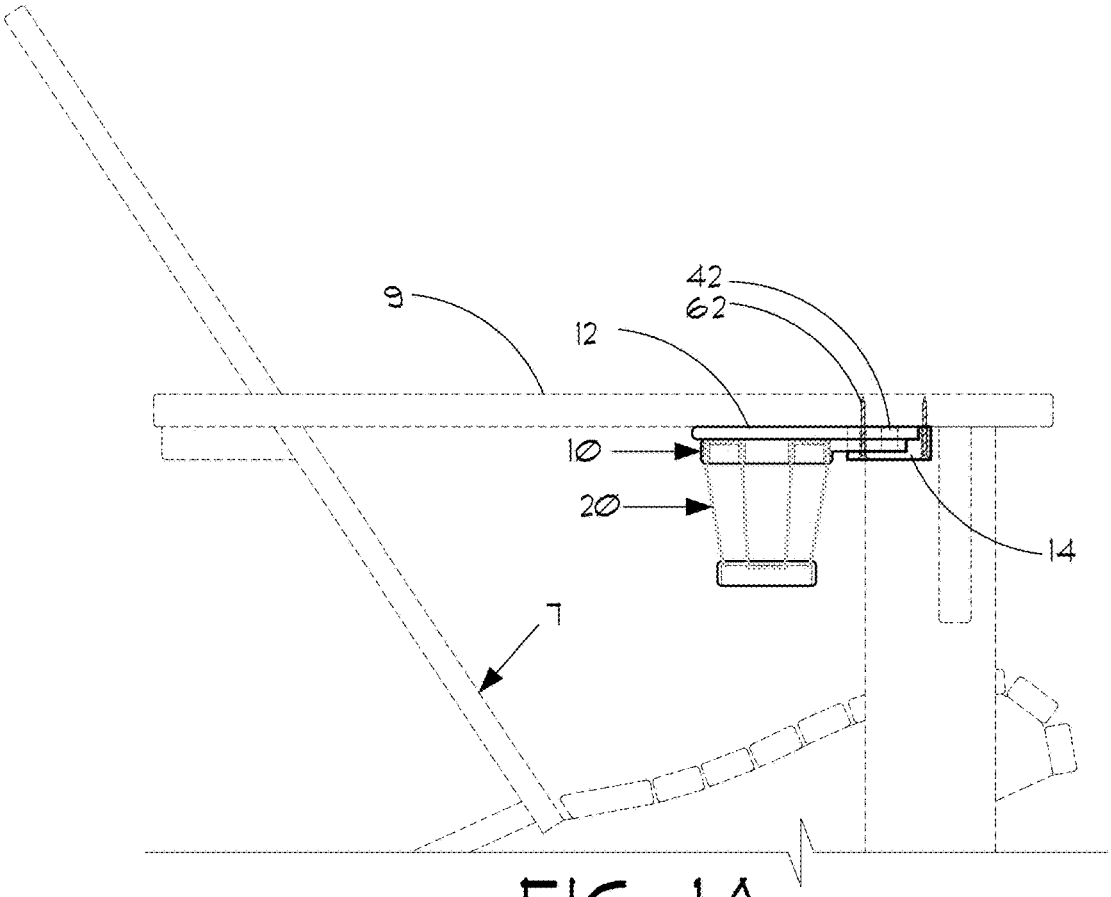
FIG. 1A illustrates a dual option retractable beverage holder mounted under an armrest of an Adirondack chair.

FIG. 1A illustrates a side view of an Adirondack chair 7 with the DORBH mounted underneath the armrest 9. In this example embodiment, the DORBH comprises a cup holder 10, a wine glass holder 12, and a mounting bracket 14. These elements may be made of a variety of materials including but not limited to plastic, wood, metal, or other shapeable and rigid materials know in the art.

In FIG. 1A and FIG. 1B, the cup holder 10 and wine glass holder 12 are shown in their retracted/stored position under the armrest 9 of the chair 7. The mounting bracket 14 is shown mounted to the underside of an armrest 9 using wood screws 62, however one of skill in the art would understand that other known methods of attaching the mounting bracket may be employed. The wood screws 62 are screwed into the armrest 9 from the bottom, and do not penetrate the top of the armrest 9.

In this example embodiment, the cup holder 10 and the wine glass holder 12 are connected to the mounting bracket 14 by a molded stem 42 that enables each of the cup holder 10 and the wine glass holder 12 to individually move between a retracted position under the armrest 9 and an extended position.

FIGS. 1B-1D show a top view of the example DORBH as it would look mounted to the armrest 9 of the chair 7. Here, the cup holder 10 is shown without a woven basket 20 for clarity.

FIG. 1B shows a top view of the mounting bracket 14 with both the cup holder 10 and the wine glass holder 12 in the retracted/stored position under the armrest 9 of a chair 7. From this view, it is clear that the DORBH fits neatly under the armrest 9 of the chair 7, and would not be seen from above when in the retracted/stored position. FIG. 1C shows a top view of the mounting bracket 14 with the cup holder 10 in the retracted/stored position, and the wine glass holder 12 in the extended position. FIG. 1D shows a top view of the mounting bracket 14 with the wine glass holder 12 in the retracted/stored position, and the cup holder 10 in the extended position.

Figure 2A:
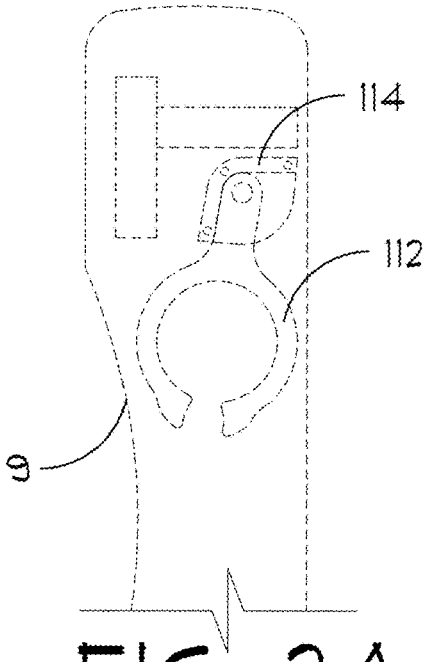
FIG. 2A shows a top view of a single option retractable beverage holder with a wine glass holder in a retracted position in under an armrest.
Figure 2B:
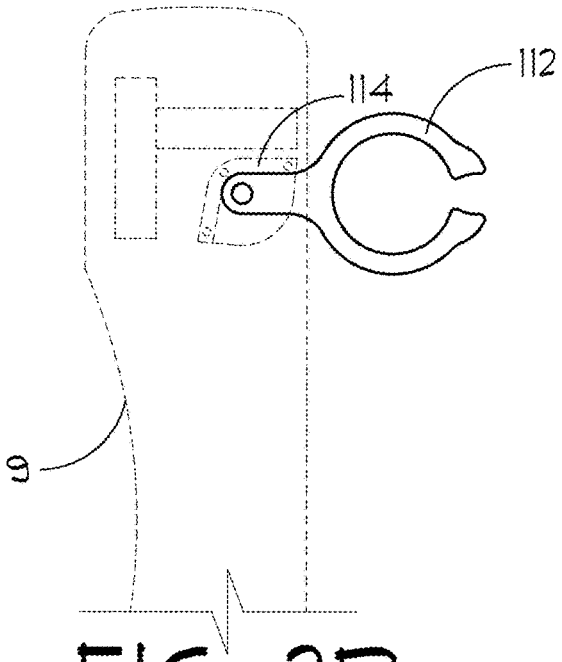
FIG. 2B shows a top view of a single option retractable beverage holder with a wine glass holder in an extended position.

FIG. 2A and FIG. 2B illustrate an example single option retractable beverage holder (SORBH) embodiment with a wine holder 112. The example embodiment is shown mounted to the armrest 9. FIG. 2A shows a top view of a mounting bracket 114 with the wine glass holder 112 in the retracted/stored position under the armrest 9. From this view, it is clear that this SORBH embodiment fits neatly under the armrest 9 of the chair 7, and it would not be seen from above when in the retracted position. FIG. 2B shows the mounting bracket 114 with the wine glass holder 112 in the extended position.

Figure 3A:
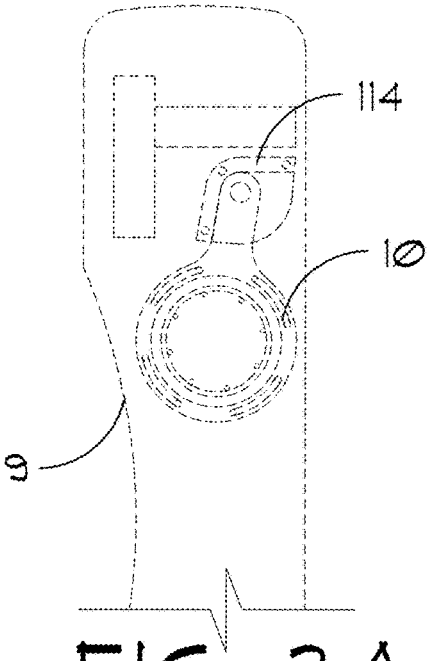
FIG. 3A shows a top view of a single option retractable beverage holder with a cup holder in a retracted position under an armrest.
Figure 3B:
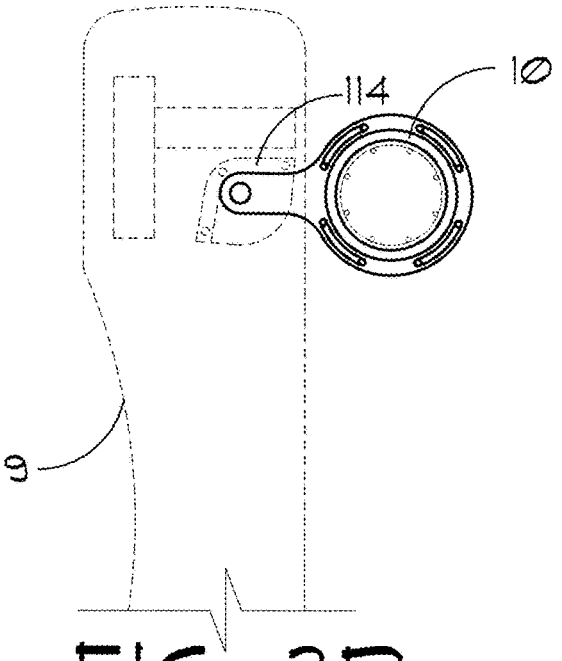
FIG. 3B shows a top view of a single option retractable beverage holder with a cup holder in an extended.

FIG. 3A and FIG. 3B illustrate an example SORBH with a cup holder 10. The example embodiment is shown mounted to the armrest 9. FIG. 3A and FIG. 3B do not illustrate the cup holder 10 with a woven basket for clarity. FIG. 3A shows a top view of the mounting bracket 114 with the cup holder 10 in the retracted/stored position under the armrest 9. From this view, it is clear that the cup holder 10 fits neatly under the armrest 9 of the chair 7, and it would not be seen from above when in the retracted position. FIG. 3B shows the mounting bracket 114 with the cup holder 10 in the extended position.

Figure 4A:
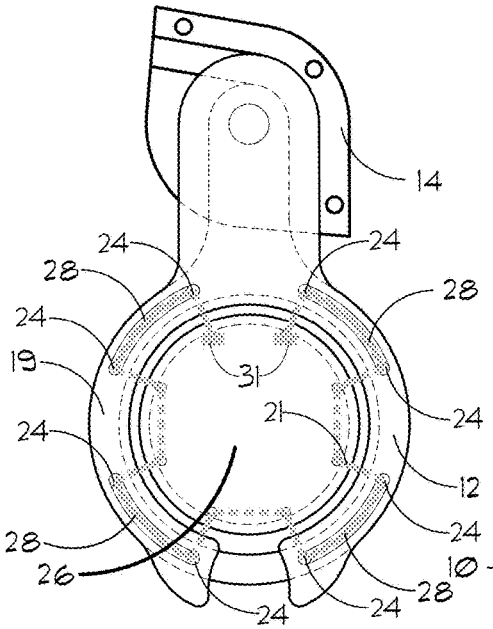
FIG. 4A shows a top view of a dual option retractable beverage holder.
Figure 4C:
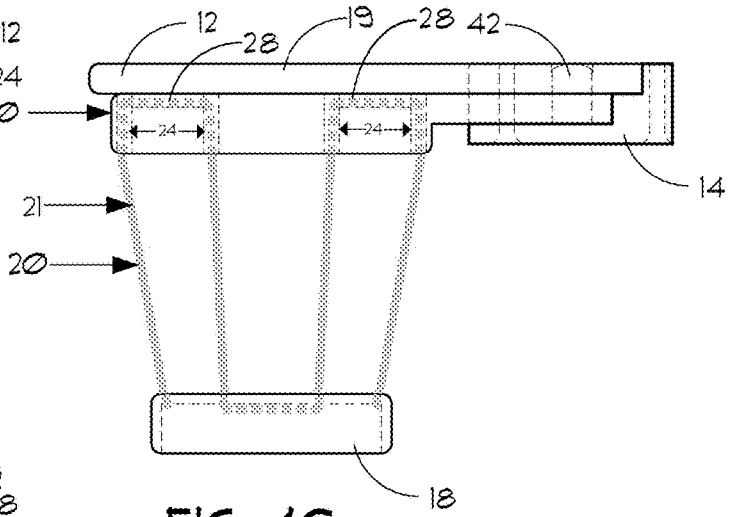
FIG. 4C shows a front view of a dual option retractable beverage holder.
Figure 4B:
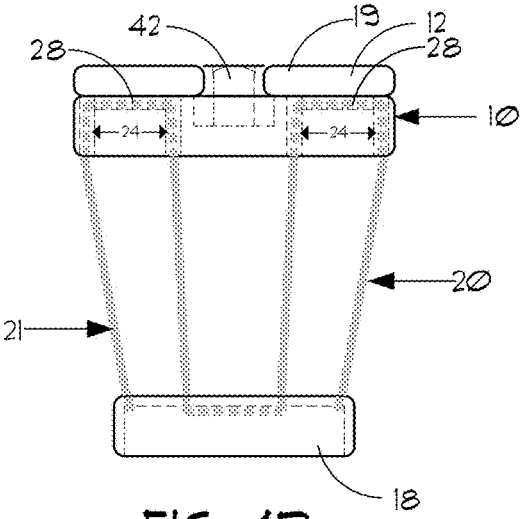
FIG. 4B shows a side view of a dual option retractable beverage holder.

FIGS. 4A-4C illustrate an example DORBH embodiment. In this example embodiment, the cup holder 10 has a round opening 26 and a woven basket 20 created from paracord 21 (or other flexible material) which would hang to support a beverage container. The paracord 21 (or other flexible material) may be woven through the cup holder 10 and the solid base 18 (i.e., puck). In this example embodiment, the woven basket 20 is shown with the puck 18 on the bottom, however the puck 18 is optional. An alternative embodiment includes a holding pocket created by weaving the paracord 21 (or other flexible material) into basket without the puck 18 at its base.

According to some embodiments, the cup holder 10 has a circular portion 19 with weaving holes 24 extending through the top and bottom surfaces of the cup holder 10. The circular portion 19 also has recessed channels 28 in between pairs of weaving holes 24 for the paracord 21 to rest in such that the top surface of the cup holder 10 may remain flat and smooth. FIG. 4A shows four recessed channels 28 located in between four pairs of weaving holes 24 that enable the cup holder 10 to retain a flat surface at the top of the cup holder 10. This allows for the wine glass holder 12 to stack on top of the cup holder 10 when the unit is fully assembled, and prevents the paracord 21 from interfering with extension or retraction of the cup holder 10 or the wine glass holder 12 when selecting only one of the beverage holders for use at a time.

The example DORBH illustrated in FIGS. 4A-4C provides a flexible holding device which is less susceptible to breakage than a rigid holder extending below the armrest 9. The cup holder 10 is an aesthetically pleasing holder for a beverage container, and this example embodiment is capable of holding most types of glasses, beer bottles, soda cans, water bottles, and juice boxes. The weave of the woven basket 20 also enables it to hold other items, including but not limited to, a cell phone and other electronic devices.

FIG. 4A shows a top view of an example DORBH. From this view, the mounting bracket 14, cup holder 10, and wine glass holder 12 are shown stacked atop one another.

FIG. 4B shows the front view of the example DORBH with the paracord 21 woven through the cup holder 10, and the wine glass holder 12 stacked on top of the cup holder 10. The mounting bracket 14 is not visible in this view, and is shown with dashed lines. FIG. 4C shows the side view of the example DORBH with the wine glass holder 12 stacked on top of the cup holder 10 in the mounting bracket 14.

Figure 5A:
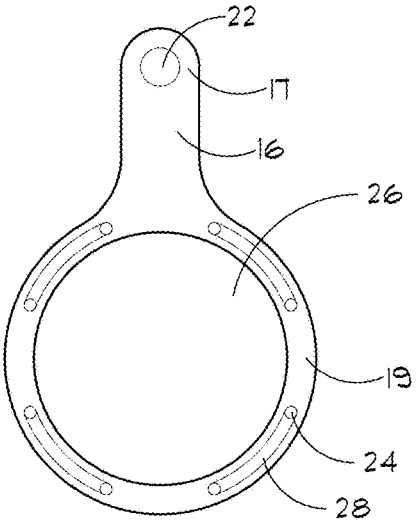
FIG. 5A shows a top view of a cup holder without a woven basket.

FIGS. 5A-5F illustrate components of the cup holder 10 in further detail. FIG. 5A shows a top view of the cup holder 10. The cup holder 10 includes a circular portion 19 and an operative arm 16. The operative arm 16 includes a mounting end 17 with an assembly hole 22 for coupling the cup holder 10 to the mounting bracket 14. According to some embodiments, the cup holder 10 connects to the mounting bracket 14 by placing the molded stem 42 through the assembly hole 22 at the mounting end 17 of the operative arm 16 of the cup holder 10.

In FIG. 5A, the cup holder 10 is shown without paracord 21 for clarity. The circular opening 26 of the cup holder 10 is for holding a beverage container. The weaving holes 24 and the recessed channel 28 are for the paracord 21 (or other flexible material) to be woven through as shown, for example, in FIGS. 5D-5F.

Figure 5B:
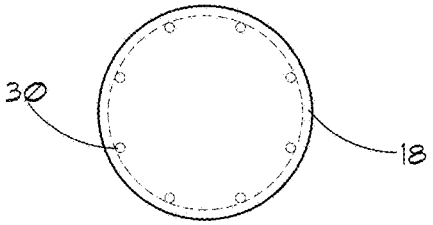
FIG. 5B shows a top view of a puck that may be suspended in a woven basket embodiment of a cup holder of FIG. 5E and FIG. 5F.
Figure 8A:
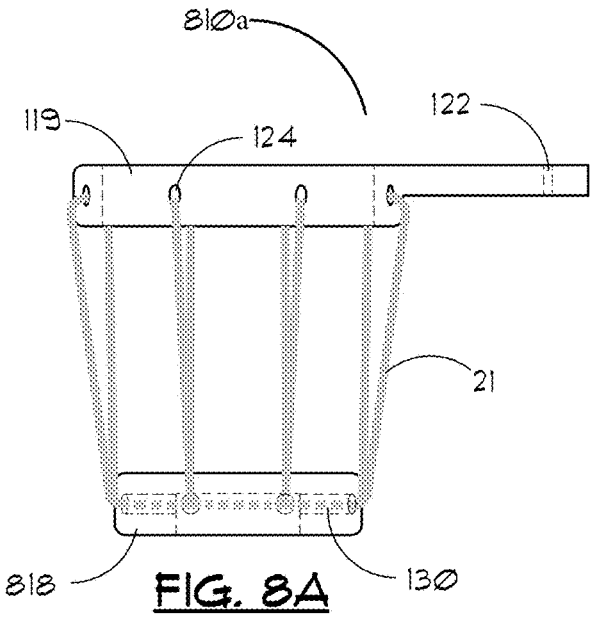
FIG. 8A shows a side view of an alternative cup holder embodiment with a woven basket.
Figure 8B:
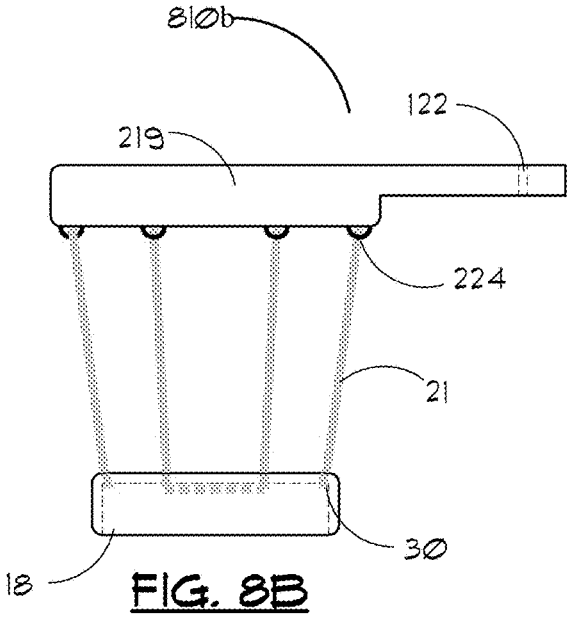
FIG. 8B shows a side view of another alternative cup holder embodiment with a woven basket.
Figure 8C:
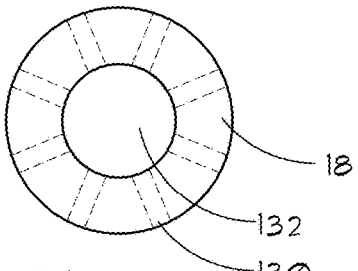
FIG. 8C shows a bottom view of an alternative puck embodiment.

FIG. 5B shows a top view of the puck 18 which is an optional base for the cup holder 10. The puck 18 has holes 30 through which the paracord 21 may be threaded to connect the puck 18 to the cup holder 10 in order to form a woven basket 20 with a solid base. An alternative embodiment of the cup holder 810 with weaving holes 130 on the side of the puck 818 is shown in FIG. 8A and FIG. 8C, and described below.

Figure 5C:
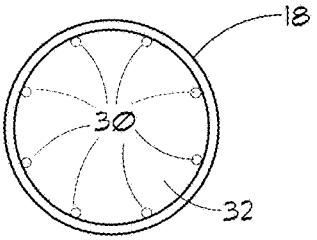
FIG. 5C shows a bottom view of the puck of FIG. 5B.

FIG. 5C shows a bottom view of the puck 18. According to this embodiment, the bottom of the puck 18 is hollow allowing for the threading of the paracord 21 through the puck 18. The paracord 21 may be knotted 31, or secured in another way, in the bottom of the puck 18 which prevents the paracord 21 from being pulled through the in holes 30. The knotting is hidden and not visible from the top of the unit. This adds to the overall aesthetics of the cup holder 10.

Figure 5D:
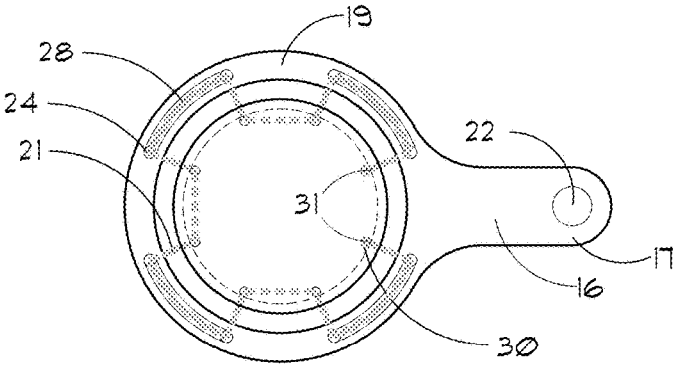
FIG. 5D shows a top view of a cup holder with a woven basket.

FIG. 5D is a top view of the cup holder 10 showing the paracord 21 threaded through the weaving holes 24 and recessed channels 28 on the top of the cup holder 10, and through the weaving holes 30 in hollow bottom of the puck 18. In some embodiments, the holes for the paracord 21 could also be on the side of, or underneath, the cup holder 10.

Figure 5E:
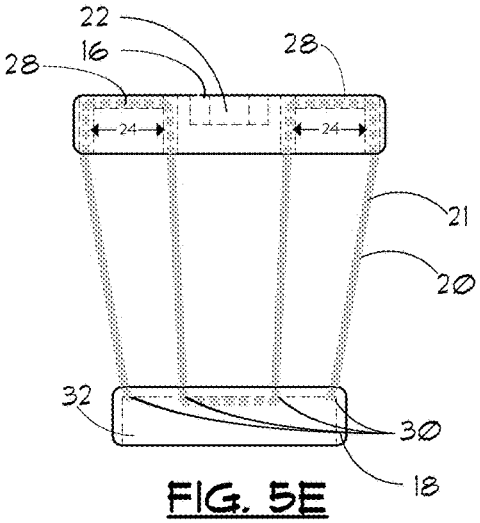
FIG. 5E shows a front view of a cup holder with a woven basket.

FIG. 5E shows the front view of the cup holder 10 with the paracord 21 woven through the weaving holes 24 in the circular portion 19 of the cup holder 10, and through the puck 18 to create a flexible and supportive basket for a beverage container to sit in. Alternative embodiments with different weaving holes are shown in FIG. 8A and FIG. 8B, and described below.

In the embodiment shown in FIG. 5E, the paracord 21 may be woven through the weaving holes 24 through the circular portion 19 of the cup holder 10 and rest in the recessed channels 28 (between pairs of weaving holes 24) to retain a flat surface throughout the top of the cup holder 10. This allows for the wine glass holder 12 to stack on top of the cup holder 10 when the unit is fully assembled, and the paracord 21 will not interfere with extension or retraction of the cup holder 10 or the wine glass holder 12 when selecting only one of the beverage holders for use. In other words, maintaining a flat smooth surface of the top of the cup holder 10 minimizes friction which could interfere with the operation of embodiments of the RBH.

Figure 5F:
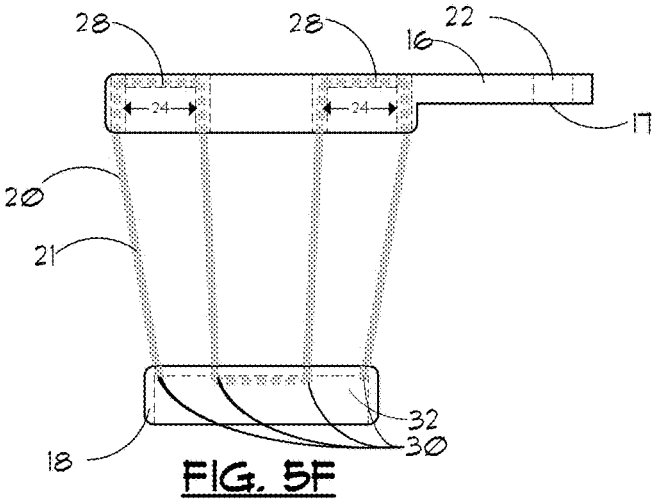
FIG. 5F shows a side view of a cup holder with a woven basket.

FIG. 5F shows the side view of the cup holder 10. The operative arm 16 of the cup holder 10, which connects to the mounting bracket 14, is visible from this view.

In the example embodiments illustrated in FIGS. 5A-5F, the woven basket 20 includes the puck 18 at the bottom. However, the puck 18 is an optional element, and a holding pocket could be created by the woven paracord 21 (or other flexible material) without the puck 18 at its base.

FIGS. 6A-6D illustrates components of different the wine glass holder embodiments (12 and 112) in detail. The wine glass holder (12 and 112) provides a sturdy holder for various types of wine glasses and tapered coffee mugs with the beverage container being supported as it rests in the circular opening 36.

Figure 6A:
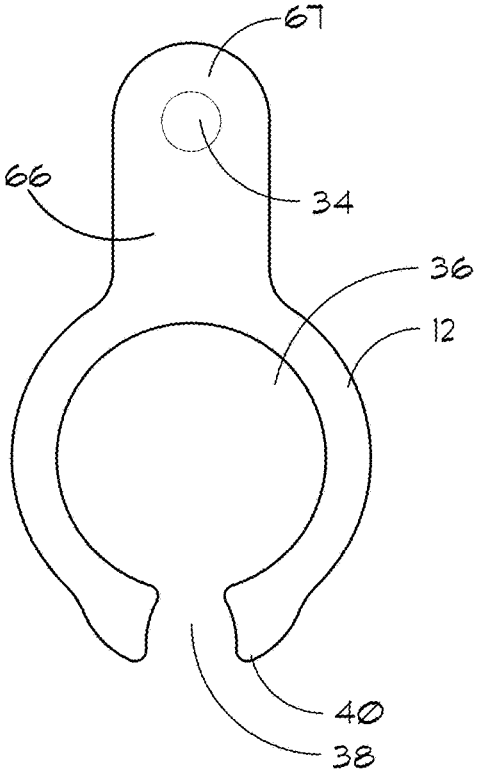
FIG. 6A shows a top view of a wine glass holder for use with a dual option retractable beverage holder.

FIG. 6A shows a top view of a wine glass holder 12 for use in a DORBH that includes both the wine glass holder 12 and the cup holder 10. According to this example embodiment, the wine glass holder 12 may couple to the mounting bracket 14 by placing the molded stem 42 through the assembly hole 34 in the mounting end 67 of the operative arm 66. Further, the wine glass holder 12 may rest on top of the cup holder 10 in assembled DORBH embodiments, as shown in FIGS. 1A-1D and 4A-4C.

According to some embodiments, the wine glass holder 12 may have a circular opening 36 with a gap 38 into which the stem of a wine glass can slide through to enable the wine containing portion of the wine glass to rest inside the circular opening 36. The size of both the gap 38 and the circular opening 36 may vary. Further, in addition to wine glass stems, the gap 38 also allows for handles of tapered coffee mugs to slide through so the tapered coffee mug may also rest in the circular opening 36 of wine glass holder 12.

Some embodiments of the wine glass holder 12 include tabs 40. The tabs 40 may extend out beyond the gap 38 to allow for a user to easily access the wine glass holder 12. The tabs 40 allow the user to blindly reach under the armrest 9 of the chair 7 to extract the wine glass holder 12 by touch, and without having to pull out the cup holder 10 in DORBH embodiments.

Figure 6B:
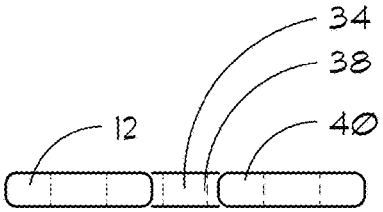
FIG. 6B shows a front view of a wine glass holder for use with a dual option retractable beverage holder.
Figure 6C:
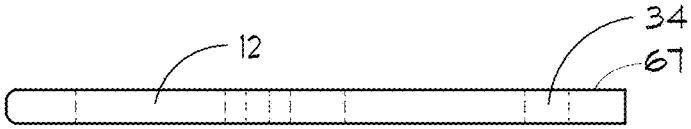
FIG. 6C shows a side view of a wine glass holder for use with a dual option retractable beverage holder.

FIG. 6B shows a front view of the wine glass holder 12 with the gap 38 visible. FIG. 6C shows a side view of the wine glass holder 12, which identifies the assembly hole 34 in the operative arm 66 of the wine glass holder 12.

Figure 6D:
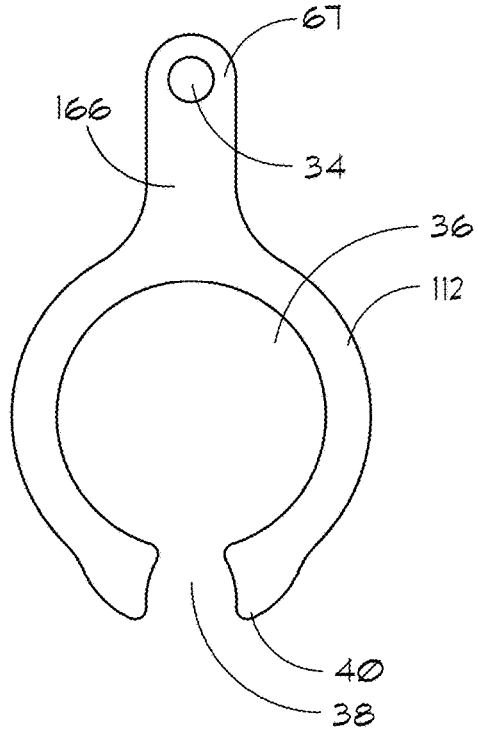
FIG. 6D shows a top view of a wine glass holder for use with a single option retractable beverage holder.

FIG. 6D illustrates an example wine glass holder 112 for use in SORBH embodiments. Wine glass holder 112 is similar to wine glass holder 12, except that the operative arm 166 of wine glass holder 112 may be narrower than the operative arm 66 of the wine glass holder 12. The operative arm 66 of the wine glass holder 12 is wider to enable the operative arm 66 to rest on the ledge 48 of the mounting bracket 14 for additional support while the wine glass holder 12 is extended and the cup holder 10 is retracted. For example, this is shown in FIG. 1C.

Figure 7A:
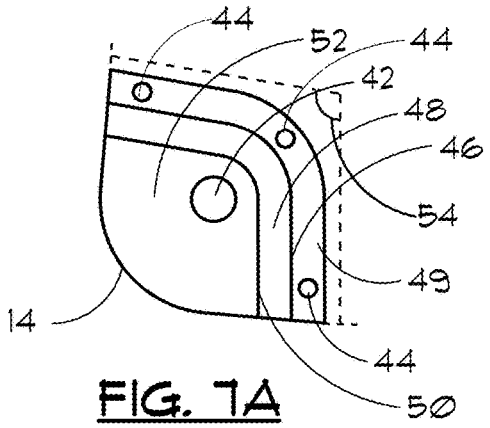
FIG. 7A shows a top view of a mounting bracket for use with a dual option retractable beverage holder.
Figure 7B:
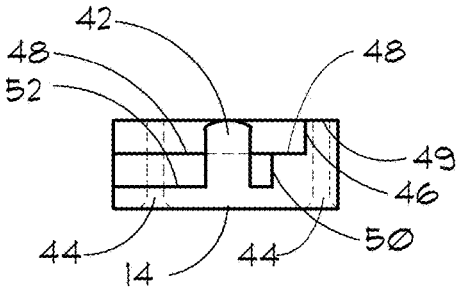
FIG. 7B shows a side view of a mounting bracket for use with a dual option retractable beverage holder.

FIG. 7A and FIG. 7B show the mounting bracket 14 of a DORBH embodiment in further detail. FIG. 7A shows a top view of the mounting bracket 14, and FIG. 7B shows a front view of the mounting bracket 14. According to some embodiments, the mounting bracket 14 may be symmetrical to allow for the full retraction of both beverage holders (10, 12) under either the left or right armrest of a chair. Because the mounting bracket is symmetrical and can be used on either the left or right arm of the chair 9, the side view would be the same as the front view.

According to this example embodiment, the three components of the DORBH (the cup holder 10, the wine glass holder 12, and the mounting bracket 14) are held together by a molded stem 42 in the mounting bracket 14 going up through the assembly hole 22 in the operative arm 16 of the cup holder 10, and then through the assembly hole 34 in the operative arm 66 of the wine glass holder 12. The assembly holes (22 and 34) and the molded stem 42 may snap together or be held in place by mounting the assembly to the underside of an armrest. FIG. 8E and FIG. 8F illustrate an alternative embodiment of the mounting bracket that uses a machine screw and a hex nut to secure the components together instead.

The example embodiment of the mounting bracket 14 depicted in FIG. 7A comprises multiple levels of support and barriers to provide stopping points for the cup holder 10 and the wine glass holder 12 so that the beverage holders are not overextended in the retracted or extracted positions. The mounting bracket 14 defines a flat surface 52 or shelf with a barrier 50 that extends above and adjacent to the flat surface 52. The barrier 50 forms an angle 54 along the length of adjacent sides of the mounting bracket 14. The barrier 50 provides a stopping point on either side of the mounting bracket 14 for the cup holder 10 as the cup holder 10 pivots across the flat surface 52 during operation.

According to this example embodiment, the top of the barrier 50 has a flat surface 48 that provides additional support to the wine glass holder 12 that rests on top of the cup holder 10 and the flat surface 48. A second barrier 46 extends above and adjacent to the flat surface 48, and provides a stopping point on either side of the mounting bracket 14 for the wine glass holder 12 as the wine glass holder 12 pivots across the top of the cup holder 10 and the flat surface 48 during operation.

Further, the top of the barrier 46 may have a flat surface 49 with mounting holes 44 extending through the barrier 46. In the example embodiment of FIG. 7A, the barrier 46 includes three mounting holes 44, with one of the mounting holes being at a vertex of the angle 54 of the mounting bracket 14, and with two mounting holes located on opposite ends of the barrier 46 from an end at the vertex. The placement of the mounting holes provides further stability for the mounting bracket 14 while it is mounted to the underside of the armrest 9.

In some embodiments, the angle 54 formed by the adjacent sides of the mounting bracket 14 may be an obtuse angle 54, as shown in FIG. 7A and FIG. 7B. The obtuse angle 54 of the mounting bracket 14 enables the beverage holders to be fully retracted under the armrest 9 of the chair 7 (as shown in FIGS. 1B-1D, 2A, and 3A), and to have the selected beverage holder to extend out at about a 90° angle from the armrest 9.

According to some embodiments, and as shown in the profile views of FIG. 4C, FIG. 6C and FIG. 7B, the height of the barrier 46 may be the same height as the wine glass holder 12. This enables the wine glass holder 12 to pivot smoothly between the underside of the armrest 9 of the chair 7, and the top of the cup holder 10. The wine glass holder 12 rests on the top of the barrier 48 which adds support in both the retracted and extended positions of the wine glass holder 12.

According to some embodiments, and as shown in the profile views of FIG. 4C, FIG. 6C and FIG. 7B, the height of barrier 50 may be the same height as the cup holder 10. This enables the cup holder 10 to pivot smoothly between underside of the wine glass holder 12 and the flat surface 52 of the mounting bracket 12.

In embodiments of both the DORBH and the SORBH, the cup holder 10 may sit on the flat surface 52 (i.e., the shelf formed by the mounting bracket). The flat surface 52 provides strength and support when the cup holder 10 is in both the extended and retracted positions.

The mounting bracket 14 may be attached to the underside of a chair arm 9 using wood screws 62 (or other securing methods or hardware) that go through the countersunk mounting holes 44 for mounting the mounting bracket 14 to the underside of a chair arm 9.

Figure 7C:
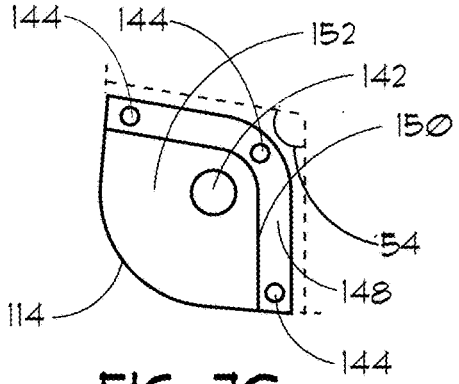
FIG. 7C shows a top view of a mounting bracket for use with a single option retractable beverage holder.
Figure 7D:
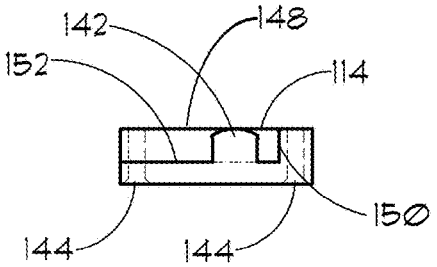
FIG. 7D shows a side view of a mounting bracket for use with a single option retractable beverage holder.

FIG. 7C and FIG. 7D show the mounting bracket 114 of a SORBH embodiment in further detail. According to some embodiments, the mounting bracket 114 may have a molded stem 142 which couples the wine glass holder 112 or the cup holder 10 to the mounting bracket 114 by placing the molded stem 142 through the assembly hole (34, 22) of the wine glass holder 112 or the cup holder 10. As shown in FIG. 7C, the angle 54 formed by the adjacent sides of the mounting bracket 114 may be an obtuse angle 54. Again, the obtuse angle 54 of the mounting bracket 114 enables either beverage holder to be fully retracted under the armrest 9 of the chair 7 (as shown in FIG. 2A and FIG. 3A), and to extend out at about a 90° angle from the armrest 9.

In the SORBH embodiments, the wine glass holder 112 or the cup holder 10 may sit on the flat surface 152 of the mounting bracket 114. The flat surface 152 provides strength and support to the wine glass holder 112 or the cup holder 10 when it is in both the extended and retracted positions, as shown in FIGS. 2A, 2B, 3A, and 3B.

In some embodiments, the height of the barrier 150 may be the same height as wine glass holder 112 and the cup holder 10. This enables either beverage holder to pivot smoothly between the underside of the armrest 9 of the chair 7, and the flat surface 152 of the mounting bracket 114. The barrier 150 provides a stopping point for the wine glass holder 112 or the cup holder 10 in both the retracted and extended positions. In the SORBH embodiments (as with the DORBH), the cup holder 10 sits on the shelf 52 which provides strength and support when it is in both the extended and retracted positions.

In some embodiments, the mounting bracket 114 may attach to the underside of the armrest 9 using, for example, wood screws 62 (or other securing methods or hardware known in the art) that go through the countersunk mounting holes 144.

FIGS. 8A-8H illustrate alternative embodiments of the components of the RBH. FIG. 8A shows a side view of an embodiment of the cup holder 810*a* with the paracord 21 woven through the weaving holes 124 through the side of the circular portion 119 of the cup holder 810, and weaving holes 130 through the side of the puck 818. This creates a flexible and supportive basket for a beverage container to sit in.

FIG. 8B shows a side view of another embodiment of a cup holder 810*b* with weaving holes or hooks 224 underneath the circular portion 219 of the cup holder 810*b*, through which the paracord 21 is threaded to connect the puck 18 to the circular portion 219 of the cup holder 810*b* forming a basket.

The foregoing embodiments enable the paracord 21 to be woven in a manner that retains a flat surface at the top of circular portion of the cup holder. Again, this allows for the wine glass holder to stack on top of the cup holder when the unit is fully assembled, and the paracord 21 will not interfere with the extension or retraction of the cup holder or the wine glass holder when selecting only one of the holders for use in the DORBH embodiments. In both of these example embodiments, a smaller assembly hole 122 in the arm of cup holder an optional method of connecting the elements of the DORBH using a machine screw (or bolt) and a hex nut, instead of the molded stem 42.

Figure 8D:
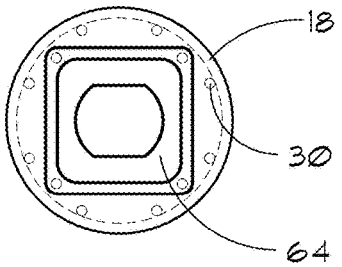
FIG. 8D shows a bottom view of another alternative puck embodiment.
Figure 8E:
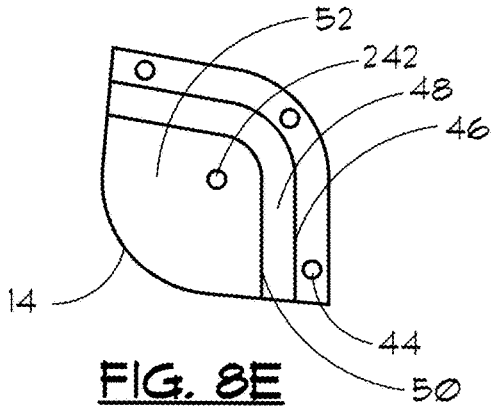
FIG. 8E shows a top view of an alternative mounting bracket embodiment for use with a dual option retractable beverage holder.
Figure 8F:
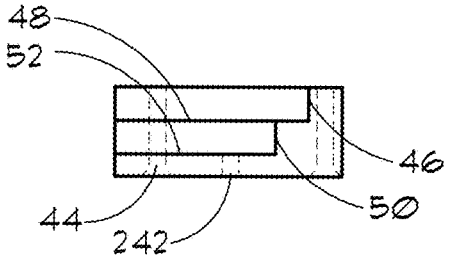
FIG. 8F shows a side view of an alternative mounting bracket embodiment for use with a dual option retractable beverage holder.

FIG. 8C and FIG. 8D show alternative embodiments of the optional puck. FIG. 8C shows the underside of the puck 818 with weaving holes 130 through the side of the puck 818 and the hollow bottom 132 of the puck 818. FIG. 8D shows an alternative embodiment of the puck 818 with an optional bottle opener 64 attached.

FIG. 8E and FIG. 8F illustrate an alternative embodiment of the mounting bracket 14 for the DORBH without the molded stem 42. In place of the molded stem 42, there is a small hole 242 which can be used with a machine screw (bolt) and hex nut. In this embodiment, the components (the cup holder 10, the wine glass holder 12, and the mounting bracket 14) can be held together by a machine screw (or other securing element known in the art) placed through the assembly hole 22 in the arm of the cup holder, and through the assembly hole 34 of the arm of the wine holder, and held together by a hex nut. The hex nut may sit in a recessed pocket in the arm of either beverage holder to allow the top of the hex nut to be flush with the top of either beverage holder. This maintains a flat surface for mounting under the armrest. In these particular example alternative embodiments, the only necessary change to the original mounting bracket 14 is the assembly hole 242, and the only necessary change to the beverage holders is the size of their respective assembly holes.

Figure 8G:
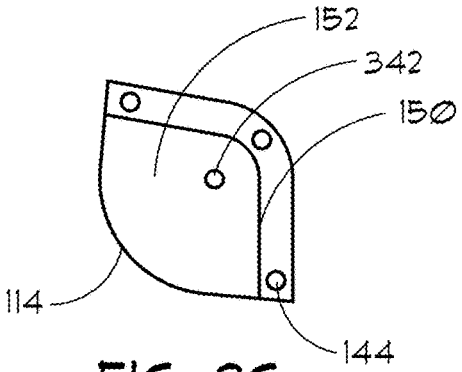
FIG. 8G shows a top view of an alternative mounting bracket embodiment for use with a single option retractable beverage holder.
Figure 8H:
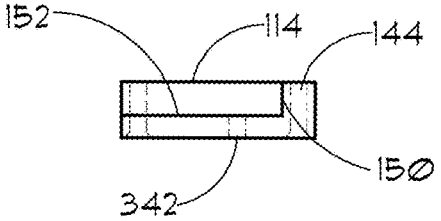
FIG. 8H shows a side view of an alternative mounting bracket embodiment for use with a single option retractable beverage holder.

FIG. 8G and FIG. 8H illustrate an alternative embodiment of the mounting bracket 114 for the SORBH without the molded stem 142. In place of the molded stem 142, there is a small hole 342 that may be used with a machine screw and hex nut. In this embodiment, the components (the cup holder 10, the wine glass holder 112, and the mounting bracket 14) can be held together by a machine screw (or other securing element known in the art) placed through the assembly hole 22 in the arm of the cup holder, or through the assembly hole 34 of the arm of the wine holder, and held together by a hex nut. The hex nut may sit in a recessed pocket in the arm of either beverage holder to allow the top of the hex nut to be flush with the top of the cup holder or the wine glass holder, maintaining a flat surface for mounting under the armrest. In these particular example alternative embodiments, the only necessary change to the original mounting bracket 114 is the assembly hole 342, and the only necessary change to the beverage holders is the size of their respective assembly holes.

In operation, according to some embodiments, the RBH is a beverage holder which is easily mounted by wood screws 62 (or other securing method or hardware known in the art) to the underside of either the left or right armrest 9 of an Adirondack chair 7, or other wide-armed chair, or any flat surface such as a table or bench. The user may reach under the armrest 9 of the chair 7 and select either the cup holder 10 or the wine glass holder 12 (in the DORBH embodiment) depending on the container of the beverage they are drinking.

In the SORBH embodiment, the user reaches under the armrest 9 of the chair 7 and pulls out the wine glass holder 112 or cup holder 10. Due to its creative design, the mounting bracket 14 provides leverage support to both the cup holder 10 and the wine glass holder 12 in both the retracted and extended positions. Beverage containers are held in a sturdy and flexible support system to reduce spills, breakage of beverageware and the loosening of the wood screws 62 (or other securing methods) used for mounting the RBH. When not in use, the RBH conveniently retracts under the armrest 9 of the chair 7 to be stowed away, and is not visible from above the armrest 9. This allows for a clean armrest surface to maintain the traditional look and feel of the Adirondack chair 7.

While example embodiments have been particularly shown and described, it will be understood by those skilled in the art that various changes in form and details may be made therein without departing from the scope of the embodiments encompassed by the appended claims.

What is claimed is:

1. An apparatus comprising:

a mounting bracket defining a first flat surface and a barrier extending above and adjacent to the first flat surface, the barrier forming an angle along a length of adjacent sides of the mounting bracket, and a second flat surface on top of the barrier defining an opening for at least two mounting holes that extend through the barrier; and a beverage holder including an operative arm with a bottom surface resting on the first flat surface of the mounting bracket and a top surface below or even with the second flat surface on top of the barrier, a mounting end of the operative arm being coupled to the mounting bracket such that the operative arm is configured to pivot across the first flat surface within the angle of the barrier.

2. The apparatus of claim 1, wherein the mounting bracket is sized and shaped to be attached to a bottom surface of an armrest, with the second flat surface on the top of the barrier in contact with the bottom surface of the armrest.

3. The apparatus of claim 1 wherein the angle is an obtuse angle.

4. The apparatus of claim 1 wherein the barrier defines at least two mounting holes, with two mounting holes located on opposite ends of the barrier.

5. The apparatus of claim 4 wherein the barrier defines at least three mounting holes, with one of the mounting holes being at a vertex of the angle of the barrier.

6. The apparatus of claim 1 wherein the mounting bracket further includes a molded stem on the first flat surface, and wherein the mounting end of the operative arm includes an assembly hole configured to receive the molded stem.

7. The apparatus of claim 1 wherein the barrier is a first barrier and wherein the mounting bracket further includes a second barrier extending upward from the second flat surface on top of the first barrier with the angle of the first barrier, and a third flat surface on top of the second barrier, the third flat surface having a smaller surface area than the second flat surface, wherein the at least two mounting holes further extend through the second barrier and the third flat surface.

8. The apparatus of claim 7 wherein the beverage holder is a first beverage holder and the operative arm is a first operative arm, and wherein the apparatus further comprises:

a second beverage holder including a second operative arm with a bottom surface resting on the second flat surface on top of the first barrier, a mounting end of the second operative arm being coupled to the mounting bracket such that the second operative arm is configured to pivot within the angle of the second barrier.

9. The apparatus of claim 8 wherein the first beverage holder is a cup holder, and the second beverage holder is a wine glass holder.

10. The apparatus of claim 9 wherein the cup holder includes at least two weaving holes with a recessed channel between the at least two weaving holes, and a woven basket of flexible material coupled to the cup holder by weaving the flexible material through the weaving holes such that the flexible material rests in the recessed channel.

11. The apparatus of claim 10 wherein the woven basket has a solid base woven into a bottom of the woven basket.

12. The apparatus of claim 11 wherein the solid base has a bottle opener.

13. The apparatus of claim 9 wherein the wine glass holder has a circular opening with a gap adapted to allow a stem of a wine glass to pass through the gap and a wine containing portion of the wine glass to rest in the circular opening.

14. The apparatus of claim 13 wherein the wine glass holder has a tab on a side of the gap for assisting a user to pivot within the angle of the second barrier.

15. The apparatus of claim 9 wherein the cup holder has a circular portion forming a circular opening for receiving a beverage container with weaving holes through a side of the circular portion for attaching a woven basket to the cup holder.

16. The apparatus of claim 9 wherein the cup holder has a circular portion forming a circular opening for receiving a beverage container with hooks underneath the circular portion for attaching a woven basket to the cup holder.

17. The apparatus of claim 8 wherein the second operative arm of the second beverage holder is wider than the first operative arm of the first beverage holder.

* * * * *